United States Patent [19]

Lee

[11] Patent Number: 4,861,024

[45] Date of Patent: Aug. 29, 1989

[54] EXERCISE BENCH

[76] Inventor: Scott Lee, Box 10, Church St., Putnam, Conn. 06260

[21] Appl. No.: 158,235

[22] Filed: Feb. 19, 1988

[51] Int. Cl.[4] ..... A63B 13/00

[52] U.S. Cl. ..... 272/123; 272/144

[58] Field of Search ..... 272/93, 123, 134, 144, 272/145; 128/33

[56] References Cited

U.S. PATENT DOCUMENTS

| | | | |
|---|---|---|---|
| 1,904,039 | 4/1933 | Broder | 272/144 X |
| 4,474,370 | 10/1984 | Oman | 272/123 |
| 4,621,809 | 11/1986 | Pearl | 272/123 |
| 4,641,837 | 2/1987 | Ruth | 272/123 |
| 4,653,751 | 3/1987 | Green | 272/144 |
| 4,773,642 | 9/1988 | Cruz | 272/123 |

FOREIGN PATENT DOCUMENTS

| | | | |
|---|---|---|---|
| 0208208 | 1/1987 | European Pat. Off. | 272/123 |

*Primary Examiner*—Richard J. Apley
*Assistant Examiner*—Robert W. Bahr
*Attorney, Agent, or Firm*—Samuels, Gauthier, Stevens & Kehoe

[57] ABSTRACT

An exercise bench comprising a frame, a platform disposed on the frame, a pair of weight supports connected to the frame at one end and optionally, a removable or fixed leg exercise device. The weight supports are angled at an obtuse angle facing the foot of the frame so that the weight supports do not interfere with a user's arms or barbells during bench pressing exercise. The platform under a user's torso is formed of a solid base and a padding, with the solid base and optionally the padding having a contoured shape cutout under the user's shoulder blades to permit articulation of the shoulder blades or movement of the shoulders below the plane of the platform. The frame also comprises a head section and a foot section, with the foot section being vertically moveable from a position coplanar with the head section to a position thereabove to permit a user to raise the foot section to a comfortable height so that when performing leg exercises using the leg exercise device, the user's feet do not touch the ground. The weight supports have hook members at the top thereof adapted to receive a dip handles for dip exercises.

7 Claims, 5 Drawing Sheets

EXERCISE BENCH

FIELD OF THE INVENTION

The present invention relates to the field of physical exercise equipment, and more particularly, to an improved weight lifting and exercise bench of the type used to perform free weight and barbell exercises and leg exercises.

BACKGROUND

The original exercise bench, which is still in use, comprises a flat raised horizontal platform supported by a frame upon which a user lies while performing various upper body exercises, such as bench presses and pullovers (which develop, for example, to a greater or lesser degree, the trapezium, latissimus dorsi, the deltiods, the biceps, subscapularis, triceps, pectoralis major and minor, the intercostals, transversalis, rectus abdominis, the internal and external oblique and quadratus muscle groups).

The use of this original bench has limitations, in that an assistant is generally required to hand the weights to and take the weights from the bench user. Moreover, a bench user, who performed exercises thereon without assistance, could be injured if he became exhausted and was unable to escape from under the weights.

To improve the above-described original bench design, vertical support members at one end of the bench were extended above the level of the platform and "J"-shaped hook members were added to the upper portions of the extended vertical support members, thereby allowing the barbell weights to be supported behind the user's head. This improved exercise bench was therefore, more convenient and safer in that a user could install a barbell on the "J"-shaped hook without assistance, and could place the barbell thereon after completion of his exercise so that he could escape from under said barbell.

Thereafter, exercise benches were provided with a platform having means for slanting the head end thereof upward relative to the horizontal portion of the end of the platform supporting a user's trunk. Using the aforementioned configuration, a weight lifter, by bench pressing with his upper torso inclined upward from a horizontal position, is required to use certain muscle groups of the upper chest and shoulders, such as the pectoralis major and minor and the deltiods, which muscle groups would not otherwise be exercised to the same extent.

One disadvantage of prior art weightlifting benches and inclined benches with vertical weight supports or barbell stands relates to the positioning of the vertical weight supports when the bench is used for bench pressing. It can be appreciated, particularly when heavy weights are used, that the ideal position of the barbell resting on the vertical weight supports, is over the neck or shoulders of the user. However, prior art benches are designed with the barbell supports disposed in a position such that the barbell rests behind the head of the user to ensure that the vertical supports do not interfere with the user's arms or the barbell when performing the bench press exercises. More specifically, because the user's arms bend out to the sides during the bench press exercise and the bar travels in a generally vertical direction over the shoulders and neck, the vertical barbell support cannot be positioned too close to the user's shoulders without interfering with the user's arm movement or the barbell. As a result of the awkward positioning of the barbell disposed on the vertical supports, it is generally difficult to remove and replace the barbell on the support before and after the exercise, without assistance. With the barbell resting on supports behind the user's head, the generally weaker muscles of the shoulders are utilized to bring the barbell into position for bench or inclined press exercises, which is both difficult and dangerous for the user. Thus, it would be desirable to have a barbell support which alleviates all of the foregoing problems.

Another problem with prior art benches which may be noted particularly during bench presses and dumbell flies is that the generally rectangular shape of the bench does not conform well to the physiology of the user during such exercises. During such exercises, the shoulder blades of the user are pressed into the bench and are restricted from articulating by the bench surface. It would be desirable to provide a bench which permits freer articulated movement of the shoulder blades.

Another prior art improvement to exercise benches was the addition of a leg exercising device. One type of such leg exercise device enables the development of the front thigh muscles, and more specifically, the quadriceps femoris (rectus femoris, vastus intermedius, vastus medials) vastus internua, sartorius, and patella tendon. To use this leg exercise device, the user sits or lies on his back on the bench with his legs hanging downward over one end thereof, generally the end opposite the vertical supports. The user's legs are tucked behind a padded member which is connected to the end of a vertical bar extending downward, the vertical bar being pivotally connected at its other end to the frame of the bench near the user's knees, such that the said vertical bar may be rotated about its pivot axis to a position approximately planar with the platform. Thus, when the user straightens his leg by flexing the quadriceps, he pivots his lower leg forward approximately 90° so that it is planar with the platform. A resistance may be added to the pivoting bar such as weights, an elastic or spring means, hydraulic pressure resitance or a pulley system.

The foregoing type of leg exercise devices are also incorporated into stand-alone devices intended solely for the purpose of performing this type of leg exercise. However, such stand-alone devices are usually arranged as chairs which are raised up off the ground a sufficient amount such that the user's feet cannot touch the ground during the exercise, and free movement of the legs is permitted. However, with respect to the leg exercise devices incorporated into a weight lifting and exercise bench, there is a problem. When performing bench exercises such as bench presses and flies, it is often desirable for the user to have his feet on the ground. This is in contradistinction to the leg exercise device, which requires that the user's feet not touch the ground. The present invention solves the foregoing problem.

Another exercise device which has recently been included on the more complex exercise benches is a bar which permits the user to perform dip exercises. In a dip exercise, the user supports himself in a vertical position on his arms, and dips or descends downward, and then back up, repetitiously, to exercise, for example, the user's triceps, deltoids, latissimus dorsi, and pectorals, among others. Some exercise benches utilize dip handles which must be carefully mounted into holes in the vertical weight supports to permit the user to perform the dip exercise thereon. However, such dip handles are not optimally mounted on the vertical supports, and are not optimally positioned to permit effective balancing of the bench, without risk of tipping. The present invention also solves the foregoing problem.

SUMMARY OF THE PRESENT INVENTION

The present invention comprises an improved weightlifting and exercise bench having a frame, a generally rectangular platform supported by said frame, said platform being divided into a head section and a foot section which are independently mounted on said frame, a pair of generally vertically disposed weight supports disposed at the head section and having an angled portion slanted toward the foot section, and a leg exercise device disposed at the foot section. The weight supports are optionally adapted to receive dip handles which may be removably mounted thereon.

The generally rectangular platform comprises a solid base member, a flexible resilient pad member covering said base member, and a cover member covering said base and said pad members. The base member is generally rectangular, except that a semicircular, circular, rectangular or similarly shaped cutout is provided in the region adjacent the position of a user's shoulder blades if such user were disposed on said platform in position to perform bench presses or similar exercises. The pad member is sufficiently flexible so that it does not interfere with the user's shoulder blades or other physiological elements in use. The pad member may either be rectangular or may conform to the shape of the base member. This construction permits relatively free, comfortable and unencumbered vertical movement of the user's arms and shoulders and articulation of the shoulder blades when the user is lying on the platform.

The generally vertical supports are coupled to the frame at or near one end thereof. The base of the each support is substantially vertical or is angled toward said one end of the frame, and the upper portion thereof, at a point above the plane of the platform, is angled toward the other end of the frame. The relationship of the base and upper portions of the supports is arranged such that the hook upon which the barbell may be disposed is substantially over the neck of the user, whereas the base portion is positioned near or behind the user's head, out of the path of the user's arms.

The leg exercise device is preferably removably coupled to the foot end of the frame, so that it can be removed when not in use and thereby limit obstruction to the user. The frame at the foot section is adapted to be vertically movable so that the frame may be disposed in the same plane as the head section for standard weight bench exercises, or, the foot section frame may be raised vertically to provide an elevated seat upon which the user may sit to perform leg exercises of the type described above, without the user's feet touching the ground. By raising the foot portion to an appropriate height, the user can also adjust the position that the leg exercise device abuts the shin or ankle to a comfortable position commensurate with the length of the user's femur. The leg exercise device is obviously movable with the foot section frame to a desirable height. The foot section frame is adapted to be locked in position at the elevated position. Also if desired, the foot section can be raised to an elevated position while the remote end of the head section platform is disposed at a low position so that the head section platform is declined from horizontal, so that, for example, decline bench presses and various leg exercises can be performed in this position.

Whereas most of the prior art dip exercise handles are designed to be used so that the user is positioned at one end of the bench, in the present invention, the handles are adapted to position the user over the bench to create a better balanced system with a decreased likelihood that the bench will tip end over. The dip handles fit conveniently into the weight support hooks which comprise a hole on one side through which an end of the dip handle passes and a j-shaped cutout on the other side of the hook upon which the handle rests. This configuration permits the convenient placement and removal of the dip handles as desired. The positioning of the user over the platform for dips allows the user to conveniently place weights, which the user may install or hold on himself during the dip exercises, on the platform, rather than on the ground, thereby providing extra convenience.

Additional features of the present invention are discussed in the detailed description of the preferred embodiment below, and shown in the drawings hereof.

DETAILED DESCRIPTION

Figure 1:
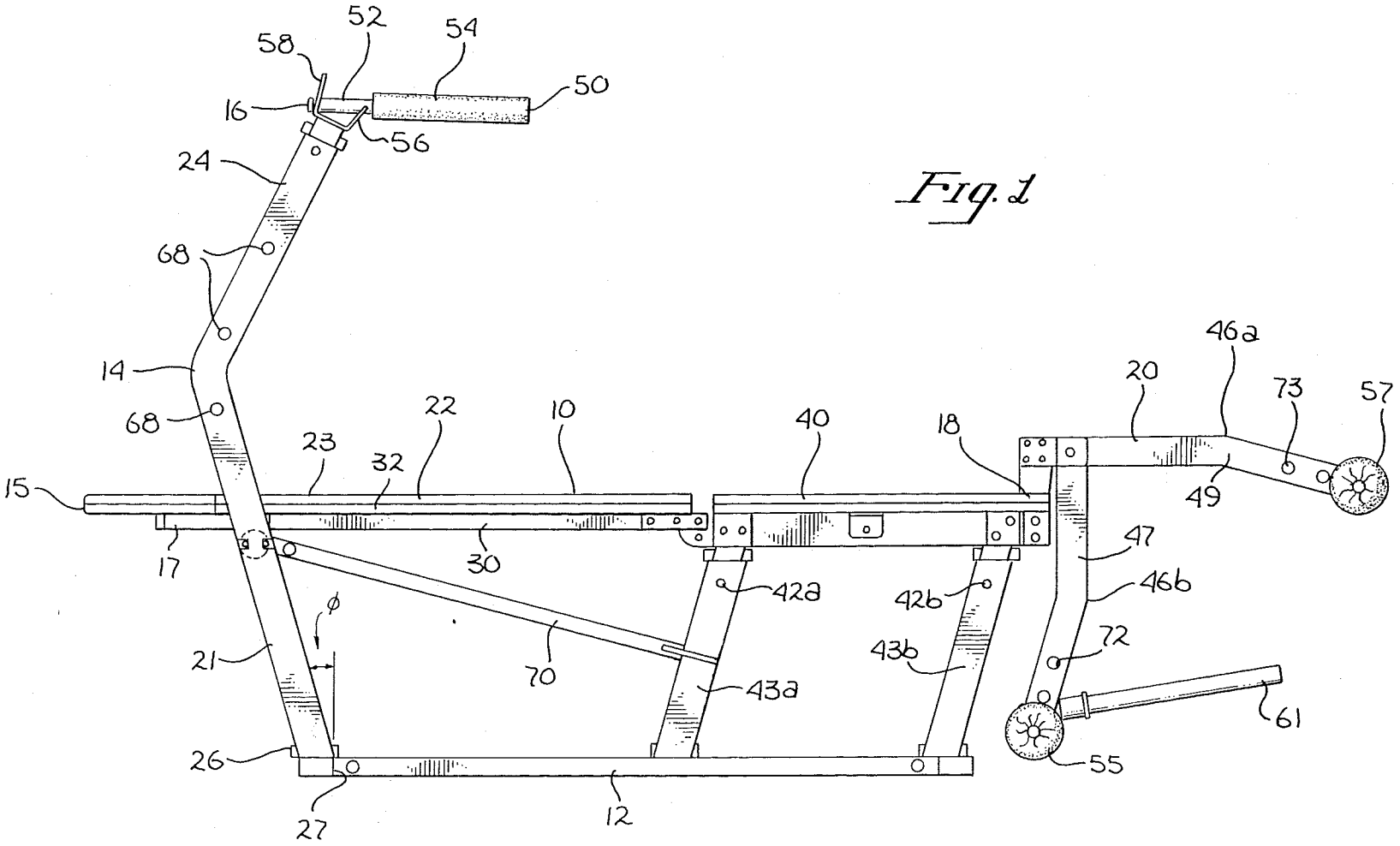
FIG. 1 illustrates a side view of the invented exercise bench.

As is shown in FIG. 1, the present invention is an exercise bench 10 generally comprising a frame 12, platform 22 supported thereon, a pair of barbell support stands 14 disposed at the head end 15 thereof with a generally j-shaped barbell hook 16 disposed at the top of each support stand 14, and a leg exercise device 20 disposed at the foot end 18 of the bench 10. The bottom portion 21 of the barbell support stands 14 is vertical or slightly angled from vertical at an angle $\phi$ away from the foot end of the bench. The top portion 24 of the barbell support stands 14 is angled toward the foot end 18 of the bench 10 at an angle $\Omega$, such that $\Omega \leqq 180-\phi$. The specific measurements of the angles are not critical, except to 16 provide that the geometry of the supports places the barbell hooks in an appropriate position directly or approximately over the neck, shoulders, or chest, and preferably the neck, of a user lying on the bench in position to perform bench presses. Bar 70 is coupled to foot support 43*a* and platform support support bar 19 to provide a reinforced construction to support heavy weights. As shown if FIG. 8, in an alternative embodiment of the platform, the edges 33 of the platform are formed to include soft foam, such as foam having a density of 3 pounds per cubic inch, and the center 35 is made to include denser foam having a density of 6 pounds per cubic inch. This provides greater support directly under the body of the user and more comfort at the edges.

As a result of this relationship, the barbell hooks 16 are disposed over, or preferably closer to the foot end 18 of the bench 10 than the base 26 of the support stand 14 where it attaches to the bottom frame member 27. In this position, as it can be seen from FIG. 1, there is a generally clear vertical path from the barbell hook 16 to the platform 22. The generally clear path is critical to one of the objectives of the present invention in that it permits a user to perform exercises on the bench without his arm movement or the barbell being impeded by the supports, as is a common problem with prior art vertical supports. The shape of the supports provides a second function discussed more fully below in that the weight of a user performing dip exercises is distributed toward the foot end of the bench creating a more stable system for such exercises.

Figure 2:
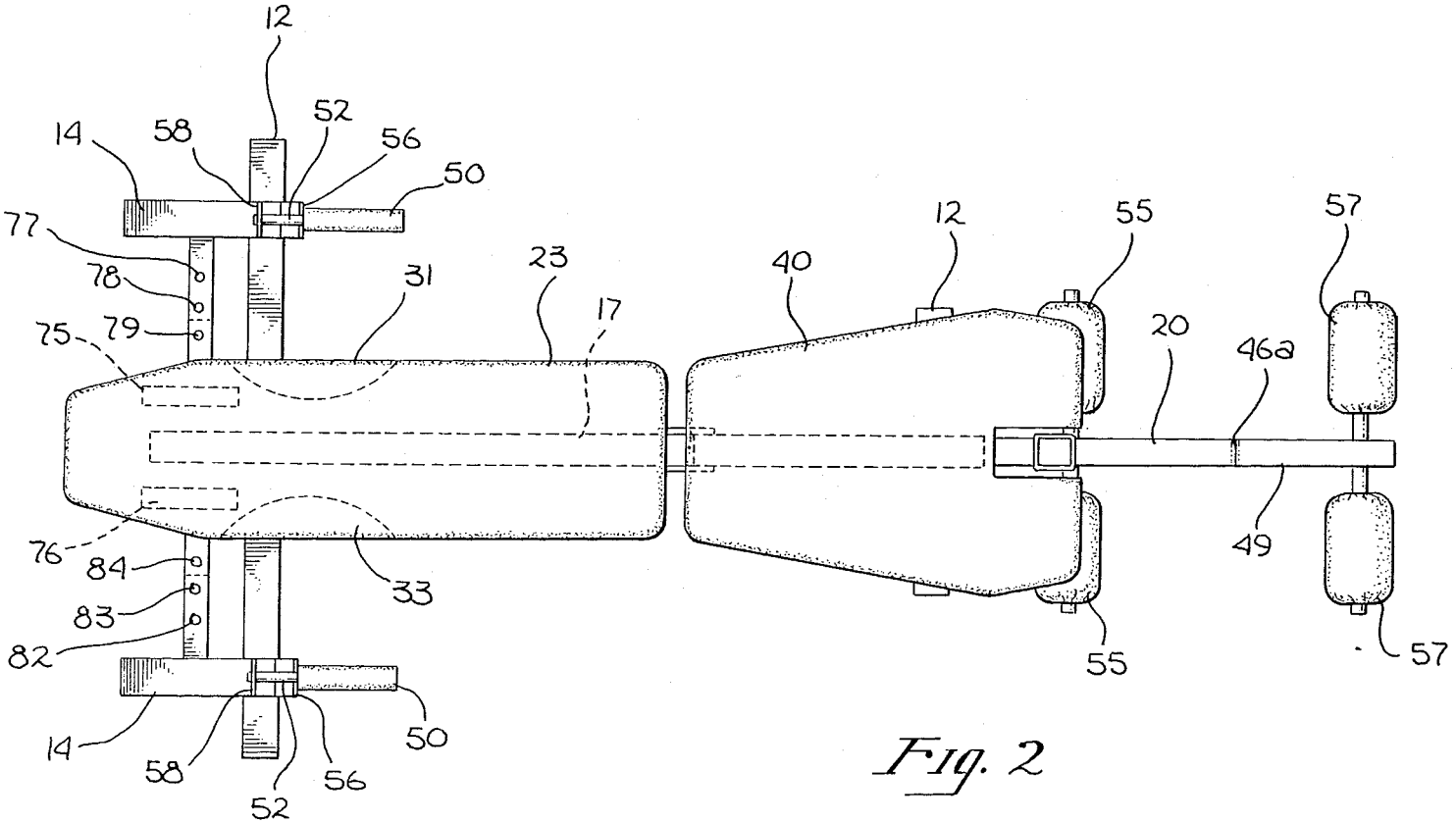
FIG. 2 illustrates a top view of the invented exercise bench with a portion of the frame supporting the platform shown in ghost lines.
Figure 8:
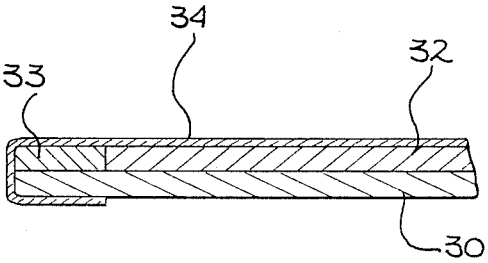
FIG. 8 illustrates a section view of the head section platform of the present invention.
Figure 7:
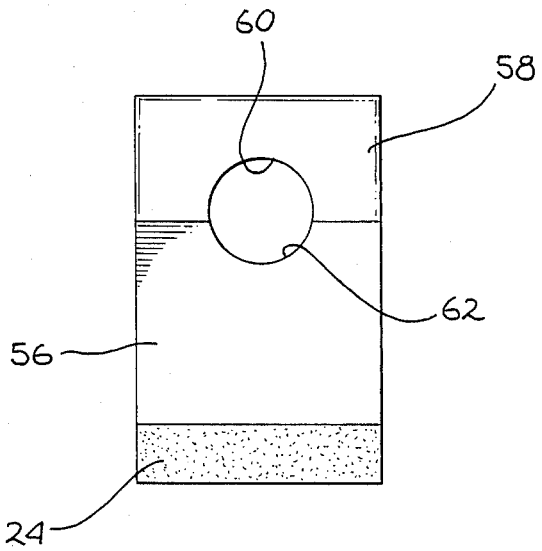
FIG. 7 illustrates an enlarged end view of the barbell support hook of the present invention without the dip handle.
Figure 5:
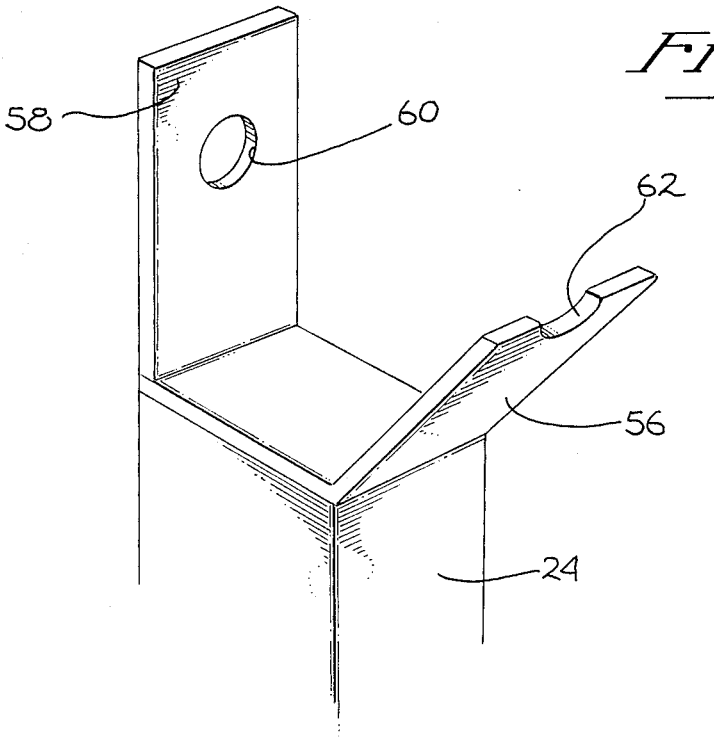
FIG. 5 illustrates a perspective view of the barbell support hook.

As is generally shown in FIG. 1, and more specifically shown in FIGS. 5, 8 and 9, the head section platform 23 is comprised of a solid member 30, a flexible, resilient pad member 32 and a cover member 34 all supported on the bench 10 on the upper frame member 17. As shown in FIG. 2, the solid member 30 comprises two cutouts 31 and 33 shown partially in ghost lines, preferably generally semi-oval in shape, or other suitable shape disposed near the side edges of the head section platform 23. The cutouts are disposed along the sides of the head section platform such that they would be positioned under the shoulder blades of most users when lying on the bench. The resilient pad 32 member may be rectangular as shown in FIG. 2, wherein the ghost lines indicate the shape of the cutouts 31 and 33 in the solid member 30. Alternatively, the pad member 32 may be configured in the same shape as the solid member 30, as shown in FIG. 9.

The cutouts 31 and 33 provide the user with the freedom of movement of his shoulders and shoulder blades during the performance of exercises while the user is lying on his back. For a general example, when performing bench presses, as the user lowers his arms, his elbows and shoulders drop and his shoulder blades articulate and are forced back below the plane of the platform without restriction. At the same time, the remainder of the user's body, including his back, hips and legs, can be comfortably disposed on a standard wide bench. The alternative, making a generally narrow bench which does not interfere with the user's movement, would not provide an effective alternative because the bench would be too narrow to be generally comfortable and would be too narrow to be stable for the user who may be lifting extremely heavy weights. Alternatively, if the user is lying on his stomach on the bench, the user's shoulders can drop below the plane of the platform.

The pad member 32 is preferably of sufficient thickness and density to provide a reasonable amount of support and comfort to the user without unduly restricting movement, particularly where the pad is configured in a rectangular shape. The cover member 34 can be plastic, leather, or other suitable material known in the art.

Figure 3:
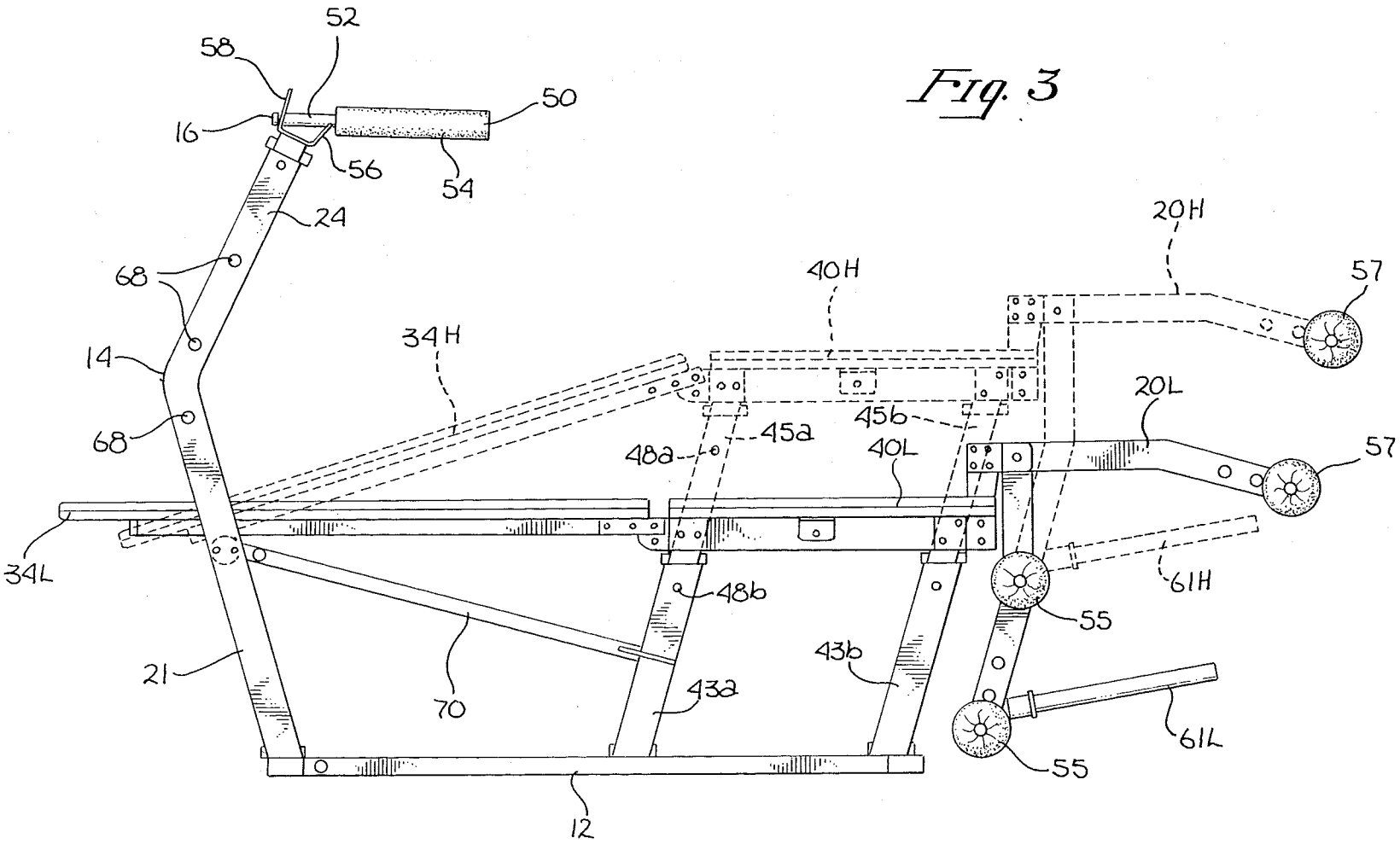
FIG. 3 illustrates a side view of the invented exercise bench showing the range of movement of the foot and head sections and the leg exercise device in the lowered and raised positions.
Figure 4:
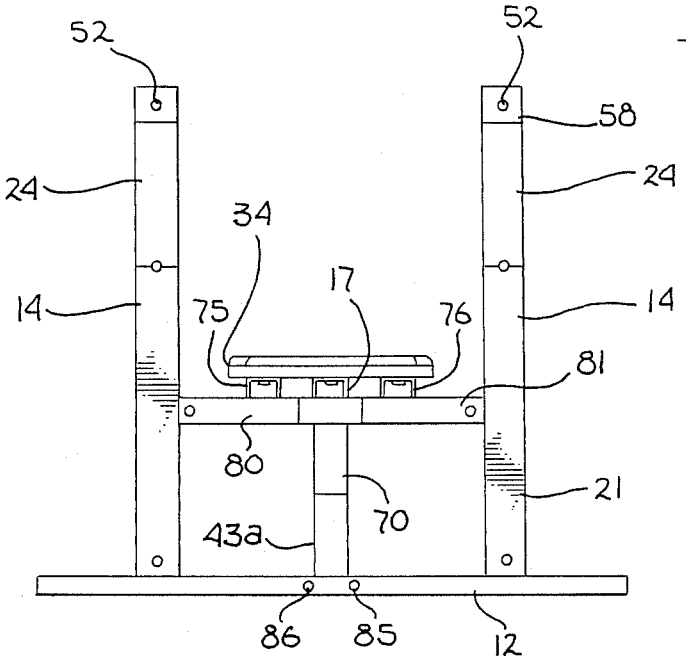
FIG. 4 illustrates an end view of the invented exercise bench.
Figure 6:
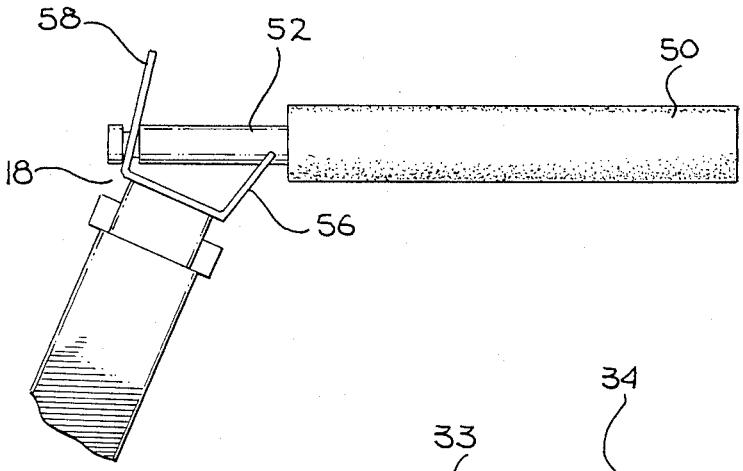
FIG. 6 illustrates an enlarged side view of the dip handle of the present invention disposed in the barbell support hook.

As is best shown in FIG. 3, the foot platform 40 is vertically moveable from a lower position 40L, shown in ghost lines, in which the foot platform is coplanar with the the head section platform 23, to at least one raised position 40H, of a pre-determined height. Preferably the foot platform 40 can be positioned in a plurality of different heights to accommodate most users comfortably. However, it is contemplated that the foot platform 40 can have only a single raised position of sufficient height that would accommodate most users such that when seated squarely on the foot platform, the user's feet cannot reach the ground. In this position, the user can perform leg exercises of the type described above without any interference which would undoubtedly occur if his feet reached the ground during such exercise. Moreover, the height of the foot platform in its lower position 40L is the standard bench height to provide the user with acceptable comfort and safety when using the bench for other exercises.

Also as shown in FIG. 3, when the foot section 40His raised, the adjacent end of the head section 34H is also raised to a level so that a decline bench is provided, with a decline of about 15° for appropriate exercises such as decline presses and various leg exercises using the leg exercise device.

As is shown in FIG. 3, the leg exercise device is moveable from position 20L to 20H when the foot platform 40 is coincidentally raised. Leg exercise device 20 is coupled to foot platform 40 by any means known in the art, and is preferably removably coupled to foot platform 40 so that it can be remove when not in use. As shown, leg exercise device 20 has a vertical 47 and horizontal 49 member with pads 55 and 57 and a weight support member 61, as is known in the art for performing leg exercises. For the purposes of this invention, the vertical member is the one used for the leg exercises which require the foot section platform to be raised.

Foot platform 40 can be locked in place in its raised or lowered position by any mechanical or other means known in the art. In the preferred embodiment, shown generally in FIG. 3, pins **42*a* and *b* are disposed through sleeves 43*a* and *b* and through holes in posts 45*a* and *b*, such as 44*a* and *b*, to secure the foot platform 40 in place. As noted above, it is preferred, but not essential, that a plurality of holes be provided along the length of posts 45*a* and *b***, to permit adjustment to a plurality of desired heights.

Leg exercise device 20 is preferably bent angled at elbows **46*a* and 46*b* for better positioning of the vertical 47 and horizontal 49 members. Also preferably provided are pad adjustment holes 72 and 73. Pads 55 and 57 are preferably removably attached to members 47 and 49 so that they can be removed and repositioned in holes 72** so that the pads may be positioned align with the desired location on the user's legs.

The present invention also comprises a novel dip exercise device comprising a pair of dip handles 50, and weight support hooks 16 adapted to accommodate said dip handles. Each dip handle comprises a sturdy metal rod 52 covered with a foam, or other resilient material, pad 54. The weight support hooks comprise a first member 58 having a hole 60 disposed therethrough slightly larger in diameter than the diameter of rod 52 so that rod 52 can be accommodated therewithin, and a second member 56 having a semicircular cutout 62 on the top portion thereof upon which rod 52 is seated. Rod 52 is preferably scored to define the seating position thereof in the support hooks 18.

The first member 58 having the hole 60 is preferably closer to the head end 15 of the bench so that in use, the dip handle is disposed so that the user is performing dips over the bench instead of at the head end 15 thereof. The former configuration is much more stable than the latter configuration in that the user's weight tip the bench, being the ends thereof.

The head section platform is preferably moveable to a plurality of raised inclined positions and placed on rods disposed through holes 68 in said weight support 14 so that it can be raised and utilized for inclined presses and flies.

As shown in FIGS. 2 and 8, the head platform is preferably, but not necessarily supported on upper frame member 17 and in addition, supported on channel supports 75 and 76 to provide extra integrity to the platform.

As is best shown in FIGS. 2 and 8, the barbell supports 14 can be moved and fixed in position closer together and farther apart, as desired. Sleeves 80 and 81 may be slid together or apart and locked in position through locking holes 77, 78 and 79 and 82, 83 and 84 as shown in FIG. 2. Base member 12 is similarly adjustable using locking holes 85 and 86.

It will be appreciated by a person of ordinary skill in the art that a number of changes can be made to the preferred embodiment described herein without departing from the spirit and scope of the present invention.

I claim:

1. In an exercise bench of the type having a frame, a platform supported by said frame, said platform comprising generally planar head and foot sections, and a pair of generally vertical weight supports disposed adjacent said head section, said weight supports having disposed thereon a hook member adapted to receive a barbell;

wherein the improvement comprises said vertical weight supports comprising a bottom portion and a top portion, said bottom portion being disposed at an angle $\phi$ from perpendicular, where angle $\phi$ is 0° to 45° angled away from said foot section and said top portion angled toward said foot section forming an obtuse angle $\Omega$ with said bottom portion, such that said hook member is disposed generally over the neck of a user lying on said platform in use;

whereby said vertical weight supports are disposed such that there is substantially no interference with a user's arms or barbell during performance of bench pressing exercises.

2. The exercise bench of claim 1 wherein said angle $\Omega$, $\leqq$, $180-\phi$.

3. The exercise bench of claim 1 further comprises said platform having a contoured shaped formed by cutouts disposed in said head section in the area underlying a user's shoulder blades in use;

whereby said cutouts permit the user substantially free articulation of the shoulders blades.

4. The exercise bench of claim 3 wherein said cutouts are generally semi-oval.

5. The exercise bench of claim 3 wherein said platform comprises a hard base member and a resilient pad member.

6. The exercise bench of claim 5 wherein said cutouts are disposed in said hard base member.

7. The exercise bench of claim 6 wherein said pad member comprises a generally rectangular sheet without said cutouts disposed therein.

* * * * *